US011761323B2

(12) United States Patent
Dunbar

(10) Patent No.: US 11,761,323 B2
(45) Date of Patent: Sep. 19, 2023

(54) FLOATING BALL PRESSURE SENSOR

(71) Applicant: Halliburton Energy Services, Inc., Houston, TX (US)

(72) Inventor: Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 157 days.

(21) Appl. No.: 17/427,973

(22) PCT Filed: May 16, 2019

(86) PCT No.: PCT/US2019/032713
§ 371 (c)(1),
(2) Date: Aug. 3, 2021

(87) PCT Pub. No.: WO2020/231444
PCT Pub. Date: Nov. 19, 2020

(65) Prior Publication Data

US 2022/0010637 A1 Jan. 13, 2022

(51) Int. Cl.

| | |
|---|---|
| ***E21B 47/013*** | (2012.01) |
| ***E21B 10/60*** | (2006.01) |
| ***E21B 47/06*** | (2012.01) |
| *E21B 47/26* | (2012.01) |
| *E21B 21/08* | (2006.01) |

(52) U.S. Cl.
CPC ..... *E21B 47/013* (2020.05); *E21B 10/60* (2013.01); *E21B 47/06* (2013.01); *E21B 21/08* (2013.01); *E21B 47/26* (2020.05)

(58) Field of Classification Search
CPC ..... E21B 47/013; E21B 47/06; E21B 21/08; E21B 10/60; E21B 47/26; E21B 10/00
See application file for complete search history.

(56) References Cited

U.S. PATENT DOCUMENTS 2,718,145 A * 9/1955 Nisle ..... G01L 9/0035 73/1.61
3,254,573 A 6/1966 Prell
(Continued)

OTHER PUBLICATIONS

ISRWO International Search Report and Written Opinion for PCT/US2019/032713 dated Feb. 14, 2020.

*Primary Examiner* — Brad Harcourt
(74) *Attorney, Agent, or Firm* — Michael Jenney; C. Tumey Law Group PLLC

(57) ABSTRACT

A drill bit may comprise a bit body including an electronic housing, one or more electronics coupled within the electronic housing, a transducer housing coupled to the electronic housing, a first transducer seated in the transducer housing, a first pressure tube extending through the bit body and coupled to the transducer housing, and a floating ball in the first pressure tube. A method may comprise allowing a drilling fluid to move through a first entrance and into a pressure tube formed in a bit body of the drill bit, allowing the drilling fluid to exert a force on a floating ball placed within the pressure tube, allowing the floating ball to transmit the force to a fluid placed within the pressure tube on an opposing side of the floating ball from the drilling fluid, and measuring pressure of the fluid with a first transducer.

23 Claims, 4 Drawing Sheets

(56) References Cited

U.S. PATENT DOCUMENTS

| | | | | |
|---|---|---|---|---|
| 3,451,263 | A * | 6/1969 | Richter, Jr. | E21B 47/06 73/152.46 |
| 4,033,186 | A | 7/1977 | Bresie | |
| 9,359,822 | B2 | 6/2016 | Crawford | |
| 9,702,245 | B1 * | 7/2017 | Dugas | E21B 47/18 |
| 2004/0049346 | A1 * | 3/2004 | Despax | G01L 19/142 702/12 |
| 2013/0153304 | A1 | 6/2013 | Crawford | |
| 2014/0262513 | A1 * | 9/2014 | Chau | E21B 47/024 175/40 |
| 2018/0010396 | A1 | 1/2018 | Dunbar et al. | |
| 2018/0030786 | A1 | 2/2018 | Dunbar et al. | |
| 2018/0195348 | A1 | 7/2018 | Ange et al. | |
| 2020/0165876 | A1 | 5/2020 | Dunbar | |
| 2021/0131263 | A1 | 5/2021 | Dunbar | |
| 2021/0131264 | A1 | 5/2021 | Dunbar | |

* cited by examiner

FLOATING BALL PRESSURE SENSOR

BACKGROUND

Wells may be drilled into subterranean formations to recover natural deposits of hydrocarbons and other desirable materials trapped in geological formations in the Earth's crust. Wells may be drilled by rotating a drill bit which may be located on a bottom hole assembly at a distal end of a drill string. During drilling operations, it may be advantageous to measure pressure on the outside of the drill bit and pressure experienced on the inside of the drill bit.

Current methods and systems used to measure pressure may utilize a rubber diaphragm or a balancing piston. However, rubber diaphragm may be susceptible to tearing and/or failing. Additionally, balancing pistons may take up large amounts of space with a drill bit and may be susceptible to jamming and may not create a fluid tight seal between clean fluids and the drilling fluids.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to measurement operations. More particularly, examples may relate to systems and methods for measuring pressure exerted on a drill bit in a drilling system. Systems and method, described below, may measure pressure applied by drilling fluid on the outside of a drill bit with a first transducer fluidly coupled to the outside of the drill bit. Additionally, pressure applied by drilling fluid within the drill bit may be measured by a second transducer fluidly coupled to the inside of the drill bit In examples, a first pressure tube may connect the first transducer to the outside of the drill bit. A second pressure tube may also connect a second transducer to the inside of the drill bit. To measure pressure, the drilling fluid may flow into the first pressure tube and the second pressure tube. As drilling fluid may include debris, a floating ball may be utilized to prevent the debris from clogging the internal workings of the drill bit, with may lead to premature drill bit failure. For example, the floating ball may form a barrier in the first pressure tube and the second pressure tube, preventing debris from entering the drill bit. The combination of a transducer, a pressure tube, and a floating ball may generally be referred to as a floating ball pressure sensor. Each floating ball pressure sensor may measure drilling fluid pressure, which may facilitate drilling operations performed by a drilling system.

Figure 1:
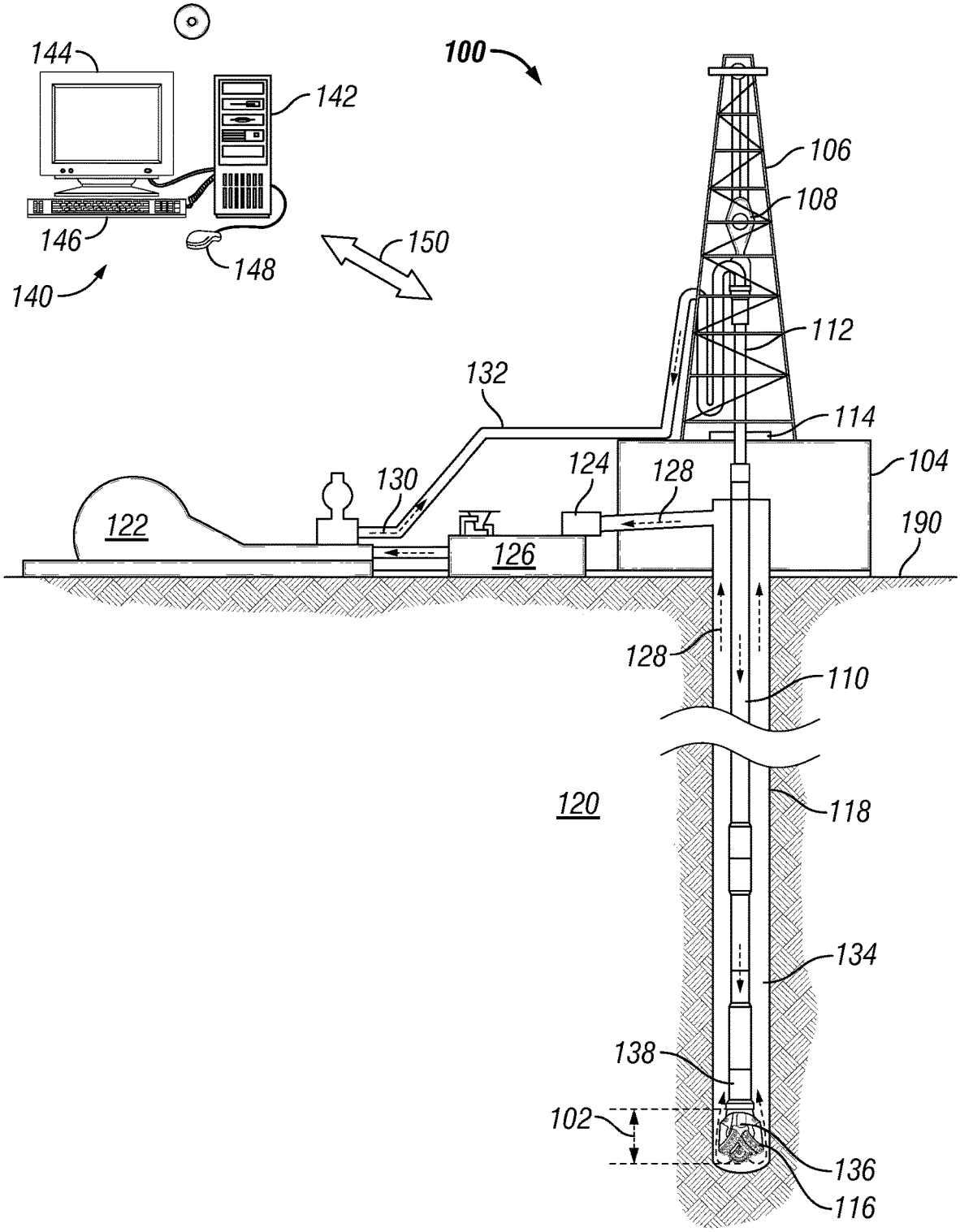
FIG. 1 illustrates an example of a drilling system.

FIG. 1 generally depicts an example of a drilling system 100 in an accordance with embodiments of the present disclosure. Drilling system 100 is illustrated as a land-based system, but those skilled in the art will readily recognize that the principles described herein are equally applicable to subsea drilling operations that employ floating or sea-based platforms and rigs, without departing from the scope of the disclosure. Drilling system 100 may perform drilling operations to form a borehole 118 with a drill bit 116. During drilling operations drilling fluid may be inserted into borehole 118 through drill string 110 to lubricate and/or cool drill bit 116. Drilling fluid may exert a pressure, through fluid, on the outside and/or inside drill bit 116. Measuring fluid pressure exerted upon the outside or inside of drill bit 116 with one or more floating ball pressure sensors during drilling operations may allow personnel to reduce excessive wear and tear on drill bit 116. FIG. 1 further illustrates one or more measurement module 102, which may be disposed on drill bit 116 at any suitable location on drill bit 116 to measure pressure. Without limitation, measurement module 102 may include one or more transducers, one or more information handling systems, circuits, wires, receivers, transmitters, repeaters, resistors, transistors, communication module, capacitors, inductors, diodes, amplifiers, gates, and/or the like.

Drilling system 100 may include a drilling platform 104 that supports a derrick 106 having a traveling block 108 for raising and lowering a drill string 110. A kelly 112 may support drill string 110 as drill string 110 may be lowered through a rotary table 114. Additionally, drilling system 100 may include a drill bit 116 attached to the distal end of drill string 110 and may be driven either by a downhole motor (not shown) and/or via rotation of drill string 110. Without limitation, drill bit 116 may include any suitable type of drill bit 116, including, but not limited to, roller cone bits, PDC bits, natural diamond bits, any hole openers, reamers, coring bits, and the like. As drill bit 116 rotates, drill bit 116 may create a borehole 118 that penetrates various formations 120.

Drilling system 100 may further include a mud pump 122, one or more solids control systems 124, and a retention pit 126. Mud pump 122 representatively may include any conduits, pipelines, trucks, tubulars, and/or pipes used to fluidically convey drilling fluid 128 downhole, any pumps, compressors, or motors (e.g., topside or downhole) used to drive the drilling fluid 128 into motion, any valves or related joints used to regulate the pressure or flow rate of drilling fluid 128, any sensors (e.g., pressure, temperature, flow rate, etc.), gauges, and/or combinations thereof, and the like.

Pressure exerted by drilling fluid within drill bit 116 may be at least partially controlled by mud pump 122, as mud pump 122 controls the flow rate and force of the drilling fluid as it moves through drill string 110 and out drill bit 116. In examples, Mud pump 122 may circulate drilling fluid 128 through a feed conduit 175 and to kelly 112, which may convey drilling fluid 128 downhole through the interior of drill string 110 and through one or more orifices (not shown) in drill bit 116. Drilling fluid 128 may then be circulated back to surface 134 via a borehole annulus 130 defined between drill string 110 and the walls of borehole 118. At surface 134, the recirculated or spent drilling fluid 128 may exit borehole annulus 130 and may be conveyed to one or more solids control system 124 via an interconnecting flow line 132. One or more solids control systems 124 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 124 may further include one or more sensors, gauges, pumps, compressors, and the like used to store, monitor, regulate, and/or recondition the drilling fluid 128.

After passing through the one or more solids control systems 124, drilling fluid 128 may be deposited into a retention pit 126 (e.g., a mud pit). While illustrated as being arranged at the outlet of borehole 118 via borehole annulus 130, those skilled in the art will readily appreciate that the one or more solids controls system 124 may be arranged at any other location in drilling system 100 to facilitate its proper function, without departing from the scope of the disclosure. While FIG. 1 shows only a single retention pit 126, there could be more than one retention pit 126, such as multiple retention pits 126 in series. Moreover, retention pit 126 may be representative of one or more fluid storage facilities and/or units where the drilling fluid additives may be stored, reconditioned, and/or regulated until added to drilling fluid 128.

To control mud pump 122 effectively, measured fluid pressure within drill bit 116 or measured fluid pressure on the outside of drill bit 166 may be communicated to surface 134 in real time. A measurement module 102 communication module 138 may operate and function to to transmit information to surface 134 as well as receive information from surface 134. In examples, communication module 138 may also transmit information to other portions of the bottom hole assembly (e.g., rotary steerable system) or a data collection system further up the bottomhole assembly. For example, communication module 138 may transmit pressure measurements and/or additional sensor measurements from measurement module 102. In addition, where processing occurs at least partially downhole, communication module 138 may transmit the processed (and/or partially processed measurements) to surface 134. Information may be transmitted from communication module 138 to surface 134 using any suitable unidirectional or bidirectional wired or wireless telemetry system, including, but not limited to, an electrical conductor, a fiber optic cable, acoustic telemetry, electromagnetic telemetry, pressure pulse telemetry, combinations thereof or the like. Communication module 138 may include a variety of different devices to facilitate communication to surface, including, but not limited to, a powerline transceiver, a mud pulse valve, an optical transceiver, a piezoelectric actuator, a solenoid, a toroid, or an RF transceiver, among others.

As illustrated, information handling system 140 may be disposed at surface 134. In examples, information handling system 140 may be disposed downhole. Any suitable technique may be used for transmitting signals from communication module 138 to information handling system 140. A communication link 150 (which may be wired, wireless, or combinations thereof, for example) may be provided that may transmit data from communication module 138 to information handling system 140. Without limitation, information handling system 140 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer, a network storage device, or any other suitable device and may vary in size, shape, performance, functionality, and price. Information handling system 140 may include random access memory (RAM), one or more processing resources (e.g. a microprocessor) such as a central processing unit 142 (CPU) or hardware or software control logic, ROM, and/or other types of nonvolatile memory. Additional components of information handling system 140 may include one or more of a monitor 144, an input device 146 (e.g., keyboard, mouse, etc.) as well as computer media 148 (e.g., optical disks, magnetic disks) that may store code representative of the methods described herein. Information handling system 140 may also include one or more buses (not shown) operable to transmit communications between the various hardware components.

Figure 2:
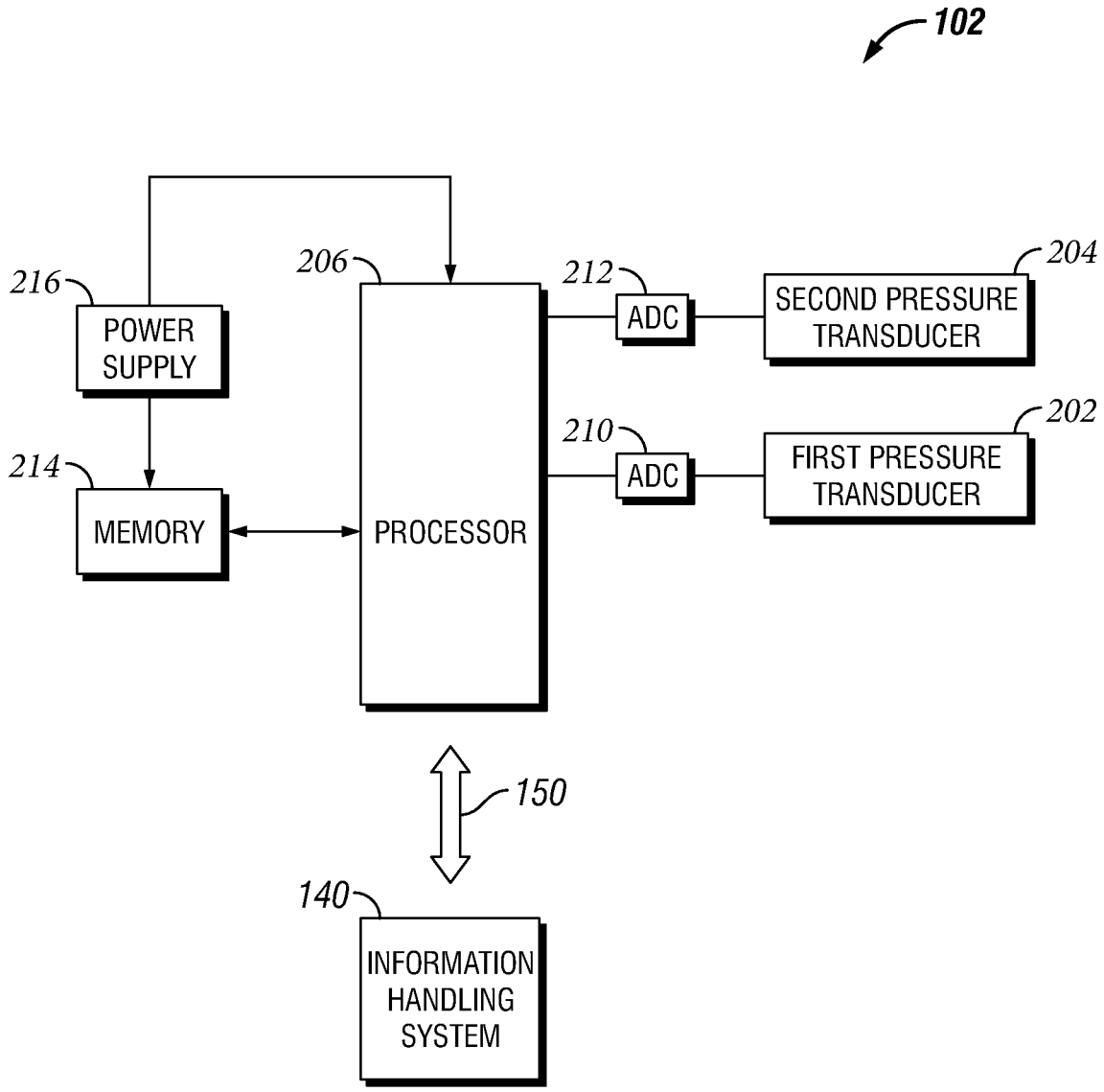
FIG. 2 illustrates an example schematic diagram of a measurement module.

FIG. 2 is a schematic diagram that illustrates measurement module 102 in more detail. As measurement module 102 may include a devices such as measurement module 102 Measurement module 102 processor 206, a first transducer 202, and/or second transducer 204. First transducer 202 and second transducer 204 may include any suitable sensor for measuring pressure from a fluid. First transducer 202 and second transducer 204 may be coupled to processor 206 by way of first analog-to-digital converter (ADC) 210 and a second analog-to-digital converter 212. Connecting processor 206, a first transducer 202, and/or second transducer 204 may form a system, which may be referred to generally within this disclosure as measurement module 102.

Pressure measurements taken at a first transducer 202, and/or second transducer 204 may be compiled and transferred between different devices, such as to communications module 138 for transmission to surface 134, by processor 206. Processor 206 may include any suitable processor or microprocessor, including, but not limited to, a digital signal processor. Processor 206 may receive measurements from first transducer 202, and/or second transducer 204, where available. Among other functions, processor 206 may collect data from the different sensors and store it or apply any set of mathematical equations to determine motion of the device or statistical significance of the data. Processor 206 may be coupled to memory 214. The measurements received by processor 206 may be stored in memory 214. Memory 214 may include any suitable type of memory, including, but not limited to RAM memory and flash memory. Measurement module 102 may further include power supply 216. Power supply 216 may supply power to components of measurement module 102, including memory 214 and processor 206. Any suitable power supply 216 may be used, including, but not limited to, batteries, capacitors, turbines and wired or wireless power delivered from higher up in the bottom hole assembly.

Measurements from the sensors, including first transducer 202, and/or second transducer 204 may be transmitted to information handling system 140. The measurements may be transmitted from measurement module 102 in borehole 118 (e.g., shown on FIG. 1) or, alternatively, may be stored downhole with transmission to information handling system 140 after recovery of measurement module 102 from borehole 118. Communication link 150, which may be wired or wireless, may transmit information from processor 206 to information handling system 140. Information handling system 140 may process the measurements to determine any of a variety of different parameters, including position of drill bit 116 (e.g., shown on FIG. 1) as a function of time. From this position, information handling system 140 may determine shape of the borehole 118 around drill bit 116, which, when combined with a depth log, may be used to generate a caliper log.

Figure 3:
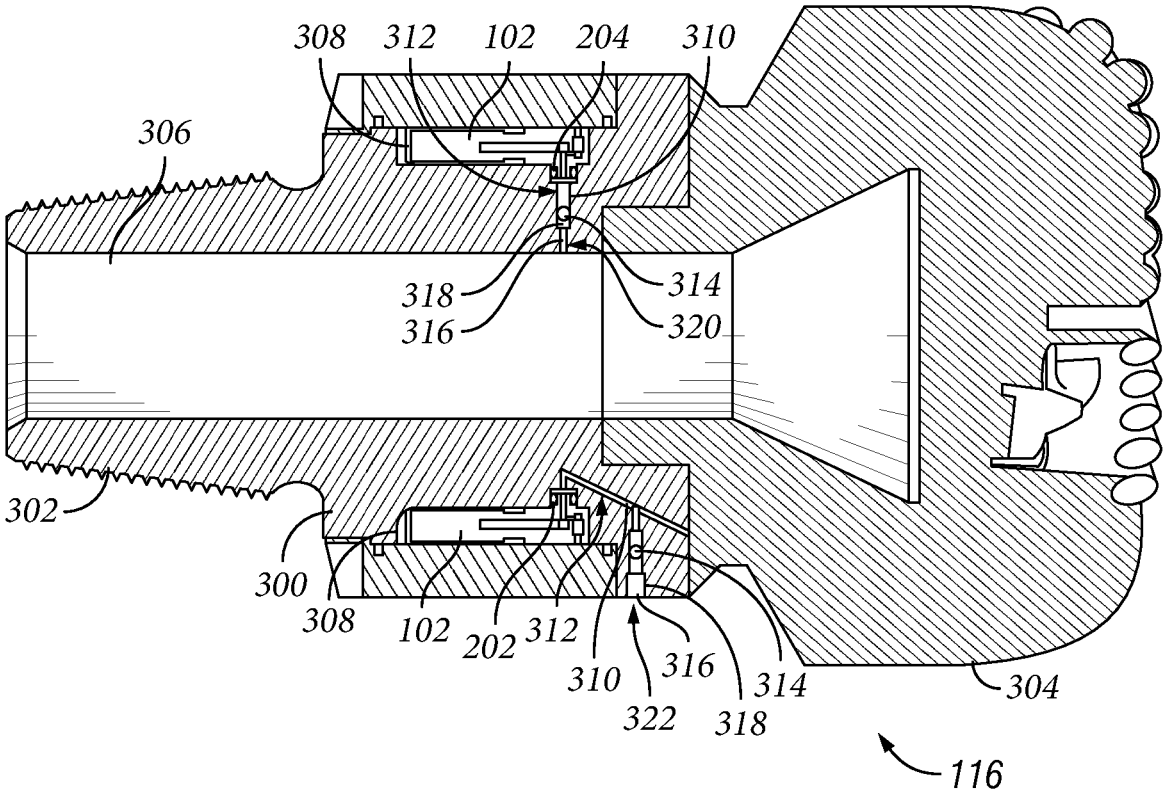
FIG. 3 illustrates a cut away view of the drill bit.

FIG. 3. illustrates a cut-away view of drill bit 116. As illustrated drill bit 116 may include a bit body 300 with a threaded connection 302 at one end of bit body 300 and one or more cutting faces 304 at the opposing end of bit body 300. A channel 306 may be disposed through the length of threaded connection 302 and bit body 300 and may terminate at and/or near one or more cutting faces 304. In examples, one or more cutting faces 304 may be utilized to cut through formation 120 (e.g., referring to FIG. 1) as described above. Threaded connection 302 may function to attach drill bit 116 to drill string 110 (e.g., referring to FIG. 1). Without limitation, bit body 300 may form a structural foundation at which threaded connections 302 and one or more cutting faces 304 may be attached. Additionally, bit body 300 may house electronic, sensors, and/or other components track and/or monitory drilling operations, as discussed above.

As discussed above in FIG. 2, measurement module 102, processor 206, a first transducer 202, and/or second transducer 204, may work together in a system to measure fluid pressure from drilling fluid and transmit the measured data surface 134. Within drill bit 116, measurement module 102 may be secured within a housing 308, which may be placed within bit body 300 as illustrated in FIG. 3. Without limitation, there may be any number of housings 308 within bit body 300 in which one or more pieces of measurement module 102 may be disposed. In addition, measurement module 102 may "wrap" around the bit body 300 within housing 308 which may also wrap around bit body 300. To "wrap" around bit body 300 is defined as placing and/or attaching different devices of measurement module 102 to conform to the circumference of drill bit body 300. In examples, there flexible substrates may be used, however, one or ordinary skill in the art understands that individual devices of measurement module 102 may be placed in any suitable area to conform to the circumference of drill bit body 300 and may be connected to other individual devices through wireless or hard wired electrical connections. For examples, first transducer 202 and second transducer 204 may be attached at different locations around the circumference of drill bit body 300 but both may be connected to processor 206 through wireless or hard wired connections Measurement module 102 measurement module 102

First transducer 202 and second transducer 204 may operate to measure pressure. As illustrated in FIG. 3, first transducer 202 and second transducer 204 may be at least a part of measurement module 102. Without limitation, first transducer 202 may measure pressure outside of bit body 300, and second transducer 204 may measure pressure inside of bit body 300, or vice versa. Without limitation, first transducer 202 may sense pressure outside of bit body 300 through one more pressure tubes 310.

Without limitation, a pressure tube 310 may be any suitable shape (e.g., square, round, cylindrical, and/or the like) and may be any suitable length. Additionally, pressure tube 310 may traverse through bit body 300 in any manner. Pressure tube 310 may function to fluidly connect first transducer 202 or second transducer 204 to pressure outside bit body 300 or pressure within bit body 300. In examples, first transducer 202 and second transducer 204 may be fluidly coupled to outside pressure or inside pressure through a fluid 312, for example oil or water, that may be disposed within pressure tube 310. During pressure measurement operations, first transducer 202 and second transducer 204 may take pressure measurements downhole by sensing the pressure in drilling fluid, which may be outside bit body 300 in annulus 130 (e.g., referring to FIG. 1) or inside bit body 300 within channel 306. It should be noted that the drilling fluid may be loaded with drilling cuttings and other particles which may plug and/or damage pressure tube 310 and/or first transducer 202 and second transducer 204. To prevent drilling cuttings and other particles from damaging pressure tube 310 and/or first transducer 202 and second transducer 204, a floating ball 314 may be disposed in pressure tube 310.

In examples, floating ball 314 may form a seal within pressure tube 310 and may separate fluid 312, which may be clean, from drilling fluid, which may include drilling cuttings and other particles. Floating ball 314 may be spherically-shaped, and may include a full sphere, although a circumferential portion which contacts pressure tube 310 in which floating ball 314 may be reciprocally received may be flattened somewhat. For example, floating ball 314 may be made entirely or at least exteriorly of an elastomer or other resilient material, which will deform somewhat when it sealingly contacts pressure tube 310.

With continued reference to FIG. 3, a retainer and/or filter 316 may prevent floating ball 314 from being discharged out of pressure tube 310 and into annulus 130 (e.g., referring to FIG. 1). In examples, filter 316 may filter the drilling fluid which may enter into one end of pressure tube 310 through entrance 318. Without limitation, entrance 318 may be oversized and/or undersized as compared to pressure tube 310. In examples, an undersized entrance 320 may not require a filter 316 and may prevent floating ball 314 from being ejected out of pressure tube 310. The smaller size may also prevent large particulates from entering pressure tube 310. Additionally, an oversized entrance 322 may provide an area for a filter 316, which may allow for a larger volume of drilling fluid to enter pressure tube 310. It should be noted that fluid 312 and the drilling fluid are isolated from fluid communication with each other by floating ball 314.

Without limitation, floating ball 314 being spherically-shaped may allow floating ball 314 to rotate within pressure tube 310 without binding, and while maintaining sealing engagement with pressure tube 310. However, in other examples, floating ball 314 may have other shapes, such as, cylindrical, barrel-shaped, etc. Any shape may be used for floating ball 314 in keeping with the scope of this disclosure.

Figure 4:
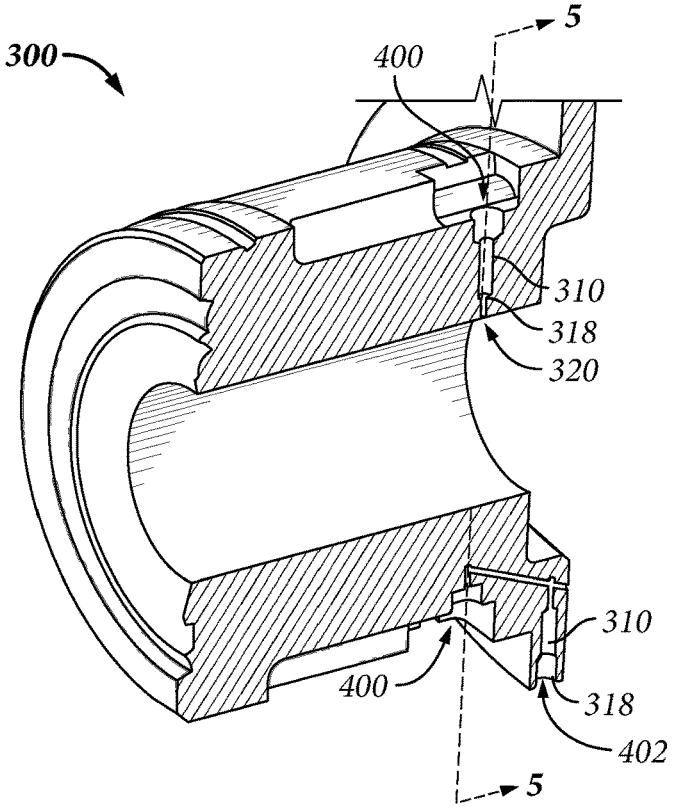
FIG. 4 illustrates a cross-sectional view of a bit body.
Figure 5:
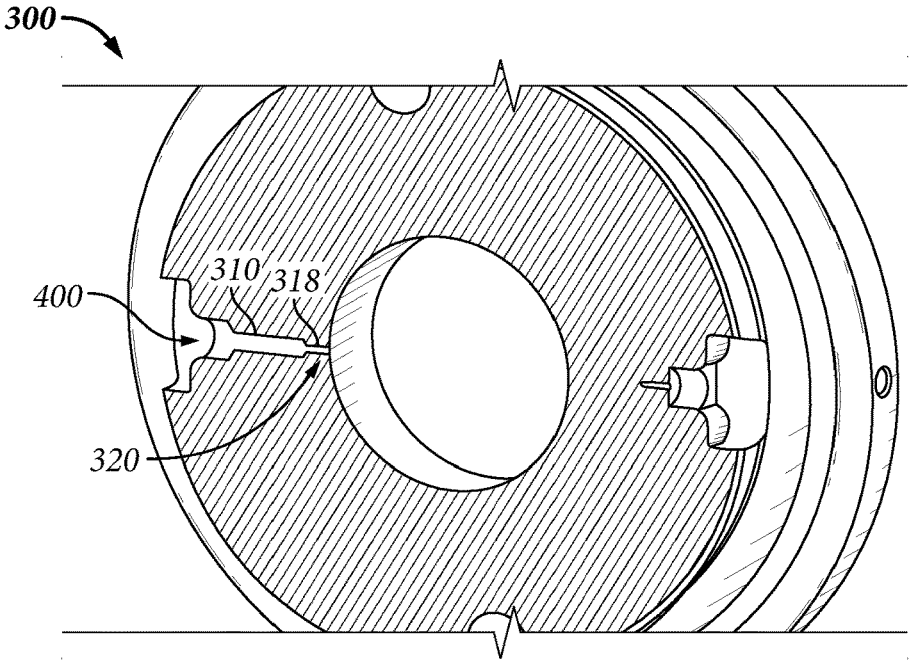
FIG. 5 illustrates another cross-sectional view of the bit body.

FIGS. 4 and 5 are additional cut-away illustrations of bit body 300. FIGS. 4 and 5 illustrate transducer housings 400 which may seat first transducer 202 or second transducer 204 (e.g., referring to FIG. 3). Seating first transducer 202 or second transducer 204 to transducer housing 400 may form a fluid tight seal. A fluid tight seal may prevent fluid from leaking between transducer housing 400 and the first transducer or second transducer 204. A leak may lead to the failure, destruction, and/or loss of electronic devices in measurement module 102. Additionally, filter housing 402, which may also be referred to as oversized entrance 322 (e.g., referring to FIG. 3), is illustrated in fluid communication with drilling fluid outside of bit body 300. FIGS. 4 and 5 further illustrate pressure tube 310 which connects to transducer housing 400. Pressure tube 310 are illustrated connected to entrance 318 which may be an undersized entrance 320 or an oversized entrance 322.

Referring back to FIG. 3, during pressure measurement operations, drilling fluid may enter into pressure tube 310 through entrance 318. The drilling fluid may be filtered by filter 316 and exert a pressure on floating ball 314. The pressure exerted on floating ball 314 from the drilling fluid may pass from floating ball 314 to fluid 312 and through pressure tube 310 to first transducer 202 or second transducer 204. First transducer 202 and second transducer 204 may function by measuring the strain on a thin plate (not illustrated) that is deflected when pressure is applied to it. This strain measurement is then back calculated to correspond to specific pressures. For example, the pressure exerted at one end of pressure tube 310 may roughly equal the pressure exerted on the strain gauged plate of first transducer 202 or second transducer 204 at the other end of pressure tube 310. It should be noted that friction from the movement of floating ball 314 may be taken into consideration. Therefore, as long as fluid 312 and floating ball 314 are free to move, pressure may be properly measured. The increase or decrease in pressure exerted upon first transducer 202 or second transducer 204 may be measured and transmitted to measurement module 102, which may store and/or transmit the measurements to the surface as described above.

Systems and methods for measuring pressure as described above are improvements over current technology as current pressure methods utilize a rubber diaphragm or a balancing piston to keep fluid 312 and drilling fluids separated. However, rubber diaphragm may be susceptible to tearing and/or failing and balancing pistons may take up large amounts of space in bit body 300, may be susceptible to jamming, and may not create a fluid tight seal between fluid 312 and the drilling fluids. As discussed above, floating ball 314 may be self-sealing and may freely rotate and move in pressure tube 310. The systems and methods described above may be easier to construct, may take up less space, and may improve pressure measurements.

The systems and methods for providing pressure measurements while drilling may include any of the various features of the systems and methods disclosed herein, including one or more of the following statements.

Statement 1. A drill bit may comprise a bit body including a transducer housing, a first transducer seated in the transducer housing, a first pressure tube extending through the bit body and coupled to the transducer housing at one end of the first pressure tube and connected at an opposing end of the first pressure tube to a first entrance on the bit body, and a floating ball in the first pressure tube.

Statement 2. The drill bit of statement 1, wherein the first entrance is an oversized entrance as compared to the first pressure tube and a filter is disposed in the oversized entrance.

Statement 3. The drill bit of statements 1 or 2, wherein the first entrance is an undersized entrance as compared to the first pressure tube.

Statement 4. The drill bit of statements 1 to 3, further comprising a fluid held within the first pressure tube between the first transducer and the floating ball.

Statement 5. The drill bit of statement 4, wherein the floating ball separates the fluid and a drilling fluid.

Statement 6. The drill bit of statements 1 to 4, further comprising an information handling system operable to receive a pressure measurement from the first transducer.

Statement 7. The drill bit of statements 1 to 4 or 6, further comprising a second transducer seated in a second transducer housing.

Statement 8. The drill bit of statement 7, further comprising a second pressure tube coupled to the second transducer housing at one end of the second pressure tube and connected to a second entrance at an opposing end of the second pressure tube.

Statement 9. The drill bit of statement 8, further comprising a measurement module including an analog-to-digital converter coupled to the first pressure transducer at one end and a processor at the opposite end and the processor is connected to an information handling machine.

Statement 10. The drill bit of statement 9, wherein the wherein the information handling machine is configured to record data from the first pressure transducer.

Statement 11. A method of sensing pressure while drilling may comprise: placing a drill bit into a borehole; allowing a drilling fluid to move through a first entrance and into a pressure tube formed in a bit body of the drill bit; allowing the drilling fluid to exert a force on a floating ball placed within the pressure tube; allowing the floating ball to transmit the force to a fluid placed within the pressure tube on an opposing side of the floating ball from the drilling fluid; and measuring pressure of the fluid with a first transducer.

Statement 12. The method of statement 11, further comprising allowing the drilling fluid to pass through a filter seated in the first entrance.

Statement 13. The method of statements 11 or 12, wherein the first entrance is an oversized entrance as compared to the pressure tube.

Statement 14. The method of statements 11 to 13, wherein the first entrance is an undersized entrance as compared to the pressure tube and prevents the floating ball from being discharged out of the pressure tube.

Statement 15. The method of statements 11 to 14, further comprising allowing the drilling fluid to pass through a second entrance formed on an inner surface of the bit body, wherein the first entrance is formed on an outer surface of the bit body.

Statement 16. The method of statement 15, further comprising allowing the drilling fluid to move through the second entrance and into a second pressure tube formed in the bit body.

Statement 17. The method of statement 16, further comprising allowing the drilling fluid to exert the force on a second floating ball placed with the second pressure tube.

Statement 18. The method of statement 17, further comprising allowing the second floating ball to transmit a second force to a second fluid placed within the second pressure tube on an opposing side of the second floating ball from the drilling fluid in the second pressure tube.

Statement 19. The method of statement 18, further comprising measuring the second force from the second fluid with a second transducer.

Statement 20. The method of statements 11 to 15, further comprising recording the pressure measured by the first transducer with an information handling system.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A drill bit comprising:

a bit body including a transducer housing;

a first transducer seated in the transducer housing;

a first pressure tube extending through the bit body, wherein one end of the first pressure tube is coupled to the transducer housing, wherein an opposing end of the first pressure tube is coupled to a first entrance on the bit body, and wherein the first entrance is an undersized entrance compared to the first pressure tube; and a floating ball in the first pressure tube.

2. The drill bit of claim 1, further comprising a fluid held within the first pressure tube between the first transducer and the floating ball.

3. The drill bit of claim 2, wherein the floating ball separates the fluid and a drilling fluid.

4. The drill bit of claim 1, further comprising an information handling system operable to receive a pressure measurement from the first transducer.

5. The drill bit of claim 1, further comprising a second transducer seated in a second transducer housing.

6. The drill bit of claim 5, further comprising a second pressure tube coupled to the second transducer housing at one end of the second pressure tube and connected to a second entrance at an opposing end of the second pressure tube.

7. The drill bit of claim 1, further comprising a measurement module including an analog-to-digital converter coupled to the first transducer at one end and a processor at the opposite end and the processor is connected to an information handling system.

8. The drill bit of claim 7, wherein the information handling system is configured to record data from the first transducer.

9. A drill bit comprising: The drill bit of claim 1, a bit body including a transducer housing;

a first transducer seated in the transducer housing;

a first pressure tube extending through the bit body, wherein one end of the first pressure tube is coupled to the transducer housing, wherein an opposing end of the first pressure tube is coupled to a first entrance on the bit body, and wherein the first entrance is an oversized entrance as compared to the first pressure tube and a filter is disposed in the oversized entrance; and a floating ball in the first pressure tube.

10. The drill bit of claim 9, further comprising a second transducer seated in a second transducer housing.

11. The drill bit of claim 9, further comprising a fluid held within the first pressure tube between the first transducer and the floating ball.

12. The drill bit of claim 11, wherein the floating ball separates the fluid and a drilling fluid.

13. A method of sensing pressure while drilling comprising:

placing a drill bit into a borehole;

allowing a drilling fluid to move through a first entrance and into a pressure tube formed in a bit body of the drill bit, wherein the first entrance is an oversized entrance as compared to the pressure tube;

allowing the drilling fluid to pass through a filter seated in the first entrance;

allowing the drilling fluid to exert a force on a floating ball placed within the pressure tube;

allowing the floating ball to transmit the force to a fluid placed within the pressure tube on an opposing side of the floating ball from the drilling fluid; and measuring pressure of the fluid with a first transducer.

14. The method of claim 13, further comprising allowing the drilling fluid to pass through a second entrance formed on an inner surface of the bit body, wherein the first entrance is formed on an outer surface of the bit body.

15. The method of claim 14, further comprising allowing the drilling fluid to move through the second entrance and into a second pressure tube formed in the bit body.

16. The method of claim 15, further comprising allowing the drilling fluid to exert the force on a second floating ball placed with the second pressure tube.

17. The method of claim 16, further comprising allowing the second floating ball to transmit a second force to a second fluid placed within the second pressure tube on an opposing side of the second floating ball from the drilling fluid in the second pressure tube.

18. The method of claim 17, further comprising measuring the second force from the second fluid with a second transducer.

19. The method of claim 13, further comprising recording the pressure measured by the first transducer with an information handling system.

20. A method of sensing pressure while drilling comprising:

placing a drill bit into a borehole;

allowing a drilling fluid to move through a first entrance and into a pressure tube formed in a bit body of the drill bit, wherein the first entrance is an undersized entrance as compared to the pressure tube;

allowing the drilling fluid to exert a force on a floating ball placed within the pressure tube, wherein the first entrance prevents the floating ball from being discharged out of the pressure tube;

allowing the floating ball to transmit the force to a fluid placed within the pressure tube on an opposing side of the floating ball from the drilling fluid; and measuring pressure of the fluid with a first transducer.

21. The method of claim 20, further comprising allowing the drilling fluid to pass through a second entrance formed on an inner surface of the bit body, wherein the first entrance is formed on an outer surface of the bit body.

22. The method of claim 21, further comprising allowing the drilling fluid to move through the second entrance and into a second pressure tube formed in the bit body.

23. The method of claim 22, further comprising allowing the drilling fluid to exert the force on a second floating ball placed with the second pressure tube.

* * * * *